US005509754A

United States Patent [19]

Conigliaro

[11] Patent Number: 5,509,754

[45] Date of Patent: Apr. 23, 1996

[54] DRIVEWAY SECURITY POST

[76] Inventor: Simone Conigliaro, 60-58 68th St., Maspeth, N.Y. 11378

[21] Appl. No.: 366,315

[22] Filed: Dec. 29, 1994

[51] Int. Cl.[6] ..... E01F 13/08

[52] U.S. Cl. ..... 404/9; 49/35; 49/49

[58] Field of Search ..... 404/6, 9, 10, 11, 404/12, 13; 49/35, 49, 131

[56] References Cited

U.S. PATENT DOCUMENTS

| | | | |
|---|---|---|---|
| 3,417,508 | 12/1968 | Sprung | 49/35 |
| 4,003,161 | 1/1977 | Collins | 49/49 X |
| 4,062,149 | 12/1977 | Collins | 49/49 |
| 5,441,359 | 8/1995 | Filippi | 49/35 X |

FOREIGN PATENT DOCUMENTS

| | | | |
|---|---|---|---|
| 1401359 | 4/1965 | France | 49/35 |
| 2269616 | 2/1994 | United Kingdom | 49/49 |

*Primary Examiner*—Ramon S. Britts
*Assistant Examiner*—James A. Lisehora
*Attorney, Agent, or Firm*—Nicholas J. Garofalo

[57] ABSTRACT

The invention provides a device which includes a bracket to be firmly embedded in a driveway; and includes a post which is adapted to be slidably seated in the bracket in a vertical position to serve as an obstruction to passage of a motor vehicle from the driveway. An Ell-rod provided in the post is manually operable to interlock the post against removal from the bracket, and is adapted to be locked in the interlocked condition by a padlock. The ell-rod is manually operable upon removal of the padlock to release its interlocked condition so as to allow removal of the post from the bracket to enable vehicle passage over the driveway.

4 Claims, 2 Drawing Sheets

GL

DRIVEWAY SECURITY POST

This invention relates to driveway obstruction devices, More particularly, it relates to the provision of a device including a post for securing obstruction era driveway to passage of a motor vehicle.

A special problem needing attention has arisen as to how to prevent in a practical manner unwarranted passage of a motor vehicle through a driveway. The need for an adequate solution to the problem has become increasingly required because of the numerous thefts of motor vehicles from garages and driveways, particularly from the garages and driveways of residential properties.

The erection of gates and chain barriers across driveways is not a practical solution to the problem. Gates require hinged supports, are cumbersome to handle, often break down and can be readily broken through. Chain barriers stretched across driveways have problems in obtaining secure connections to their supports, are cumbersome to handle and also, readily subject to be broken through.

Accordingly, a general object of this invention is to provide a practical solution to the problem of providing means for securing obstruction of a driveway to unwarranted passage of a motor vehicle.

A more particular object, of the invention is to provide a device that includes a post of heavy metal which may be seated in a vertical position in a support firmly embedded in a driveway, which may be securely locked against removal from the support, and which, when needed, may be unlocked and removed from the support to allow unobstructed motot vehicle passage through the driveway.

BRIEF SUMMARY OF THE INVENTION

The invention provides a device which includes as a support a hollow bracket that is adapted to be firmly embedded in the ground of a driveway, and includes a post that is adapted to be seated in the bracket in a vertical position so as to obstruct motor vehicle passage through the driveway, wherein the post includes an ell-rod that is adapt, ed, when manually turned, to interlock the post to the bracket, whereby removal of the post from the bracket is prevented; and wherein the ell-rod is arranged in the post to permit, padlocking of the ell-rod to the post so as to maintain the interlocked condition of the post, to the bracket. The interlocked condition of the post to the bracket and the padlocked condition of the ell-rod to the post serve to securely lock the post from being removed from the bracket. It is apparent that the padlock may be removed, and the interlocked condition of post and bracket may be released so as to allow removal of the post, to clear the driveway for unobstructed passage of a motor vehicle. Handle means on the post serve to facilitate manual seating into and removal of the post from the bracket.

The foregoing and other objects, features and advantages of the invention will appear more fully hereinafter from a consideration of the accompanying description which follows, taken together with the accompanying drawing wherein an embodiment of the invention is illustrated. It is to be expressly understood, however, that the drawing is for purposes of illustration and description, and it is not to be construed as defining the limits of the invention.

DETAILED DESCRIPTION OF THE INVENTION

Figures 1, 2, 3, 4, 5:
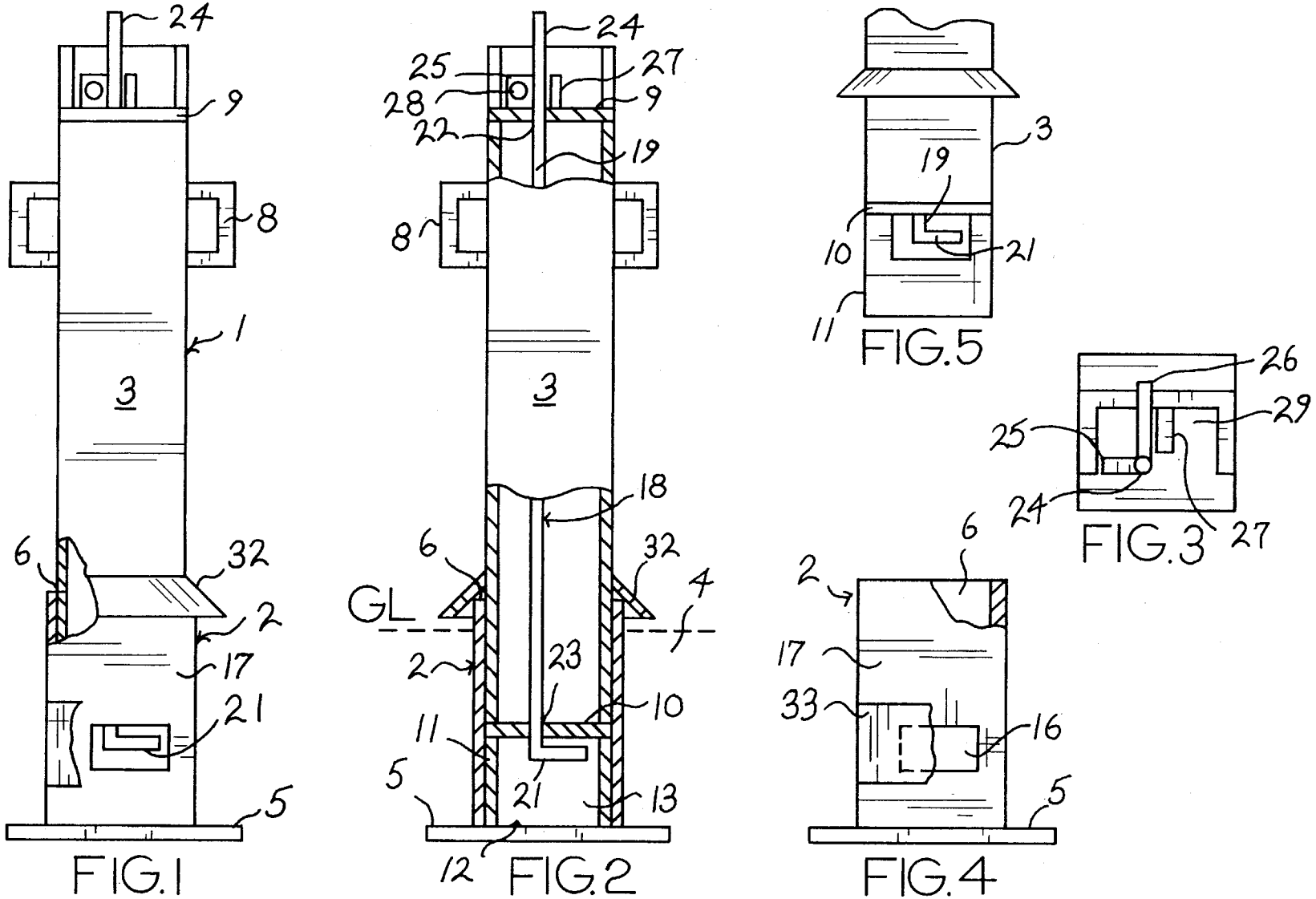
FIG. 1 is a front elevation view of a device embodying the invention.
FIG. 2 is a front elevation view of the device, partly in section, and illustrated as erected in a driveway.
FIG. 3 is an enlarged plan view of the top ends of FIGS. 1 and 2.
FIG. 4 is a front elevation view of the bracket element of the device apart from the post.
FIG. 5 is a front elevation view of the lower portion of the post element of the device apart from the bracket.

Reference is now directed to the accompanying drawing, wherein is disclosed a device 1 illustrating an embodiment of the invention. It includes a hollow elongated bracket 2 which serves to support in a vertical position a hollow post 3. The bracket is intended to be deeply embedded, as appears in FIG. 2, in the ground 4 of a driveway. A plate 5, welded to the bottom of the bracket and extending beyond the sides of the bracket, serves to reinforce and firmly secure the bracket against movement. It is preferable that the bracket be cemented into the ground. When embedded in the ground, it is intended that an open top end 6 of the bracket project above ground level (GL) for several inches, but not to an extent that it would block passage of a motor vehicle through the driveway, While the bracket may have various forms, it is preferably square in its cross section, and that its hollow interior 6 also be square in its cross section.

The post 3 is a component of the device 1, and it is an element separate from the bracket. Its body has a cross section complementary to that of the bracket, whereby it is adapted to be entered into the bracket with a slide fit and seated within the bracket, as appears in FIG. 2. The post is of a length enabling it to project from its seated condition above ground level (GL) sufficiently to block and obstruct passage of a motor vehicle through the driweway. The post is provided with side handles 8, whereby it may be manually lifted out of the bracket to allow unobstructed motor vehicle passage through the driveway.

Figure 7:
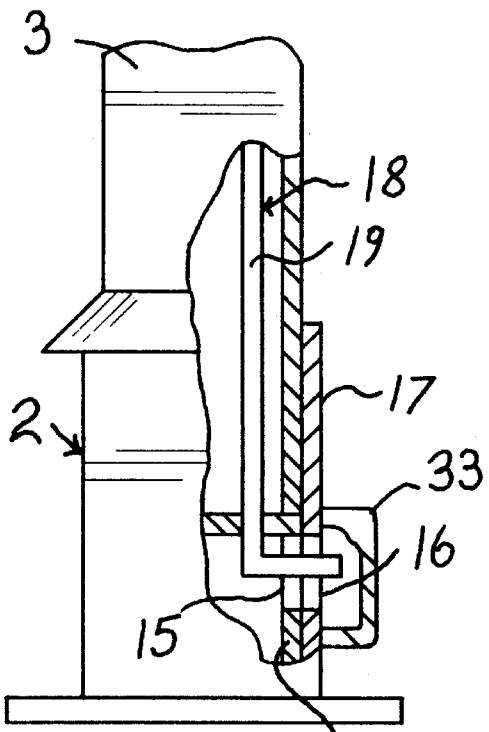
FIG. 7 is a side view of the lower portion of FIG. 2, showing the ell-rod element interlocked with the post and the bracket, a condition obtained upon turning of the ell-rod from the position shown in FIG. 2.

The post is hollow, and it is provided with top and bottom end walls 9, 10. An extension 11 of the post below its bottom wall 10 rests upon an internal wall 12 of the bracket in the seated condition of the post in the bracket. The extension 11 provides a recess 13 below the bottom wall 10 of the post. In a side wall 14 of the recess is an opening or port 15, which is aligned in the seated condition of the post with a complementary opening or port 16 in a side wall 17 of the bracket, as appears in FIG. 7.

To prevent unwarranted removal of the post, as by vandals seeking to steal a vehicle parked in the driveway, means 18 is provided for interlocking the post to the bracket, and for maintaining the interlocked condition with a padlock. The means 18 includes an ell-rod, that is, a rod having an elongated main portion 19 terminating at its bottom with an ell or right angle extending foot 21. Here, the elongated portion 19 of the rod extends through complementary holes 22, 23 in the top and bottom walls 9. 10 of the post into the recess 13 below the bottom wall 10. An upper portion 24 of the rod projects above the top wall 9 of the post. A wing 25 extending radially from the rod portion 24 rests upon the top wall 9 of the post, whereby it curbs downward movement of the rod relative to the post. The foot 21 at the bottom end of the rod is abuttable with the underside of the bottom wall 10 of the post, whereby upward movement of the rod is limited.

Figure 6:
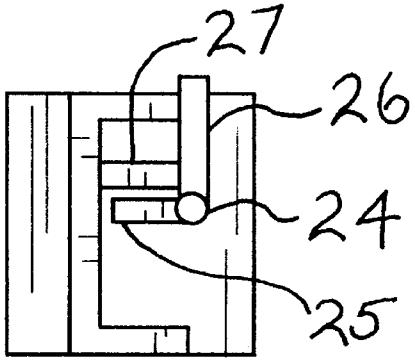
FIG. 6 is an enlarged plan view of the top end of the device showing the wing of the ell-rod in abutment, with the stop, a condition obtained upon a turning of the ell-rod as in FIG. 7.

A short handle 26 extending radially from the upper end of the rod portion 24 permits manual turning of the rod relative to the top and bottom walls 9, 10 of the post. When the rod is turned clockwise from a position, as appears in FIG. 2, in which its foot end 21 is fully located in the recess 13, to a position, as appears in FIG. 6, in which the wing 25 at the upper end of the rod abuts a stop wall 27 welded to the top wall 9 of the post, a hole 28 in the wall of the wing 25 will be aligned with a complementary hole 29 in the wall of the stop 27. The foot 21 at the bottom of the rod is caused in such turning to project through the aligned ports 15, 16 of the post and bracket, as appears in FIG. 7, whereby the post and bracket become interlocked to each other against relative movement. In its interlocked condition the post is prevented from being lifted out of the bracket.

Figure 8:
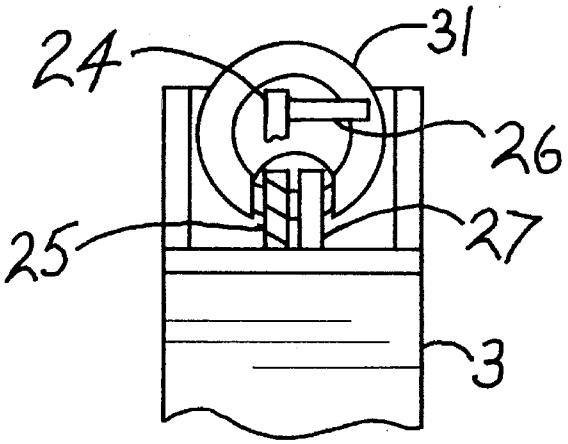
FIG. 8 is an enlarged elevation view of a portion of the upper end of the device, wherein a padlock is shown locking the wing of the ell-rod in abutment with the stop.

Now, to maintain this interlocked condition of the post with the bracket, a padlock 31, as appears in FIG. 8, is caused to be engaged in the aligned holes 28, 29 of the wing 25 and the stop 27, whereby the rod becomes clamped or locked in its interlocked condition, and the post is restrained from being lifted free of the bracket. The post in its seated condition in the bracket and locked against removal provides an obstruction to passage of a motor vehicle through the driveway that is secured by its locked condition against removal by vandals.

To allow removal of the post from the bracket so as to enable unobstructed passage of a motor vehicle through the driveway, the padlock is removed, and the rod is manually turned counter-clockwise to draw its foot end out o,f the aligned holes 15, 16 and back into the recess 13, as appears in FIG. 2. The post then becomes free of its interlocked condition. The handles 8 may then be manually gripped to lift the post out of the bracket.

The components of the device are made of hard metal, such as steel, to provide a strong obstruction to any motor vehicle attempting to drive through the driveway. The hollow structure of the post and its short length, preferably a length of approximately three feet, and its narrow cross section width of approximately three inches, provide a post of a weight that enables it to be easily manually lifted without strain to be entered into or lifted out of the bracket.

A downwardly inclined collar 32 welded about the lower portion of the post is adapted in a seated condition of the post, as appears in FIG. 2, to closely overhang the open top end 6 of the bracket, whereby the bracket is sheltered against entry of rainwater and dirt.

A cover 33 (FIGS. 4, 7) is welded to the side wall 17 of the bracket over the port 16, whereby the port: is sealed against entry of dirt snd water into the bracket.

A suitable cap, not shown, may be provided to cover the top end of the post.

While an embodiment of the invention has been illustrated and described in detail, it is to be expressly understood that the invention is not limited thereto, and it is my intent, therefore, to claim the invention not only as shown and described but also in all such forms and modifications thereof as may be reasonably construed to fall within the spirit of the invention and the scope of the appended claims.

What is claimed is:

1. A driveway obstruction device comprising a hollow bracket serving as a supporting base for the device and having an open top end, a hollow elongated post adapted to be slidably seated in the bracket through the open top end and when seated to project vertically several feet above the open top end, the post having interior upper and lower horizontally extending walls, an ell-rod extending vertically in the post with a slide fit through complementary holes in the upper and lower walls, the ell-rod having at its bottom end below the lower wall a radially extending foot, the ell-rod having on an upper portion thereof a radially extending wing resting upon the upper wall, and the ell-rod being arranged in the post and limited by the complementary holes in the upper and lower walls for turning relative to the post about a vertical axis so that, upon turning of the ell-rod in one direction about its vertical axis its foot is caused to project through aligned ports in side walls of both the seated post and the bracket whereby the post becomes interlocked with the bracket against movement of the post out of the bracket, and upon turning of the ell-rod in the opposite direction its foot is caused to be drawn out of the aligned ports whereby the post becomes unlocked from the bracket to allow its movement out of the bracket.

2. A driveway obstruction device as in claim 1, wherein the post is made of metal and has fixed upon its upper wall an upstanding stop wall, the wing of the ell-rod is caused to abut the stop wall upon turning of the ell-rod in the one direction, the wing has a hole through it that is alignable in the abutting relation with a complementary hole in the stop wall, and a padlock is engageable with the aligned holes of the stop wall and the wing of the ell-rod to lock the ell-rod in its interlocked condition with the post and the bracket.

3. A driveway obstruction device as in claim 1, wherein the bracket is embedded in a vehicle driveway with its open top end exposed above ground level, and the aligned ports in the side walls of the seated post and bracket are below ground level.

4. A driveway obstruction device comprising a hollow elongated bracket serving as a supporting base for the device, the bracket having an open top end, a hollow post adapted slidably to be seated into the bracket through the open top end of the bracket, and an ell-rod extending vertically through the post supported in the post for turning about a vertical axis relative to the post, the ell-rod having at its bottom end an ell-foot, the ell-rod being vertically arranged and supported in the post so that upon turning of the ell-rod in one direction about its vertical axis the ell foot is caused to project through aligned ports in side walls of the seated post and bracket whereby the post is interlocked to the bracket against movement of the post out of the bracket, and the ell-rod is caused upon being turned about its vertical axis in the opposite direction to draw the ell foot out of the aligned ports whereby the post is unlocked from the bracket to allow its movement out of the bracket.

* * * * *